US009685713B2

(12) United States Patent
Takahashi

(10) Patent No.: US 9,685,713 B2
(45) Date of Patent: Jun. 20, 2017

(54) ANTENNA DEVICE

(71) Applicant: NEC Corporation, Tokyo (JP)

(72) Inventor: Yoshihide Takahashi, Tokyo (JP)

(73) Assignee: NEC Corporation, Tokyo (JP)

( * ) Notice: Subject to any disclaimer, the term of this patent is extended or adjusted under 35 U.S.C. 154(b) by 24 days.

(21) Appl. No.: 14/655,945

(22) PCT Filed: Jul. 17, 2013

(86) PCT No.: PCT/JP2013/004354

§ 371 (c)(1),
(2) Date: Jun. 26, 2015

(87) PCT Pub. No.: WO2014/103092

PCT Pub. Date: Jul. 3, 2014

(65) Prior Publication Data

US 2015/0357719 A1 Dec. 10, 2015

(30) Foreign Application Priority Data

Dec. 28, 2012 (JP) ..... 2012-288918

(51) Int. Cl.

| | |
|---|---|
| ***H01Q 19/19*** | (2006.01) |
| ***H01Q 1/12*** | (2006.01) |
| *H01Q 13/02* | (2006.01) |

(52) U.S. Cl.

CPC ..... *H01Q 19/192* (2013.01); *H01Q 1/1228* (2013.01); *H01Q 13/02* (2013.01); *H01Q 19/191* (2013.01)

(58) Field of Classification Search

CPC ..... H01Q 19/17; H01Q 19/19; H01Q 19/191; H01Q 19/192; H01Q 19/132; H01Q 1/1228; H01Q 13/02

(Continued)

(56) References Cited

U.S. PATENT DOCUMENTS 4,521,783 A * 6/1985 Bryans ..... H01Q 13/0208 343/781 CA
4,978,967 A 12/1990 Masujima (Continued)

FOREIGN PATENT DOCUMENTS

CN 2082464 U 8/1991
DE 41 40 841 A1 7/1992

(Continued)

OTHER PUBLICATIONS

International Search Report mailed Oct. 22, 2013 in corresponding PCT International Application.

(Continued)

*Primary Examiner* — Lam T Mai

(74) *Attorney, Agent, or Firm* — Finnegan, Henderson, Farabow, Garrett & Dunner, L.L.P.

(57) ABSTRACT

An antenna device capable of performing precise positioning by using a small number of components and having a low side-lobe characteristic is provided. An antenna device includes a primary radiator (3), a main-reflector (2), a sub-reflector (5), and a holding section (4) that fixedly maintains relative positions and directions of the sub-reflector (5) and the main-reflector (2). The holding section (4) includes a side part (42) in an integrated manner, the side part (42) being configured to enclose at least a part of a radio-wave path extending from the primary radiator (3) to the sub-reflector (5) as a shroud.

18 Claims, 4 Drawing Sheets

(58) Field of Classification Search
USPC ..... 343/873, 779, 786, 781 CA
See application file for complete search history.

(56) References Cited

U.S. PATENT DOCUMENTS

| | | | | |
|---|---|---|---|---|
| 6,295,034 | B1 * | 9/2001 | Brown | H01Q 3/2658 343/781 CA |
| 2012/0139807 | A1 * | 6/2012 | Simon | H01Q 25/001 343/786 |
| 2015/0084820 | A1 * | 3/2015 | Ahn | H01Q 13/02 343/779 |

FOREIGN PATENT DOCUMENTS

| | | |
|---|---|---|
| DE | 44 12 769 A1 | 10/1995 |
| JP | 52-149627 | 11/1977 |
| JP | 53-136941 | 11/1978 |
| JP | 56-37706 | 4/1981 |
| JP | 56-37707 | 4/1981 |
| JP | 60-157303 | 8/1985 |
| JP | 64-30918 | 2/1989 |
| JP | 64-47114 | 3/1989 |
| JP | 1-135108 | 5/1989 |
| JP | 7-46031 | 2/1995 |
| JP | 7-202561 | 8/1995 |

OTHER PUBLICATIONS

Extended European Search Report issued by the European Patent Office in counterpart European Patent Application No. 13869348.6, dated Aug. 2, 2016.

Chinese Office Action issued by the Chinese Patent Office in counterpart Chinese Patent Application No. 201380068840.5, dated Jul. 28, 2016.

* cited by examiner

ANTENNA DEVICE

CROSS-REFERENCE TO RELATED PATENT APPLICATIONS

This application is a National Stage Entry of International Application No. PCT/JP2013/004354, filed Jul. 17, 2013, which claims priority from Japanese Patent Application No. 2012-288918, filed Dec. 28, 2012. The entire contents of the above-referenced applications are expressly incorporated herein by reference.

TECHNICAL FIELD

The present invention relates to an antenna device, and in particular an antenna device including a primary radiator, a main-reflector, and a sub-reflector.

BACKGROUND ART

An antenna device including a primary radiator, a main-reflector, and a sub-reflector has been used. Such an antenna device needs to be strong enough for outdoor use. Further, such an antenna device needs to have a low side-lobe characteristic according to the use.

For example, Patent Literature 1 discloses an antenna device including: a side plate in the form of a cylindrical shell attached to the outer circumference of a main-reflector, a housing in the form of a truncated cone shell that accommodates a part or the whole of a sub-reflector and a primary radiator and is attached to the side plate; and a reinforcement shell formed by a part of a conical shell attached to the left/right sides of the side plate and the housing. With this configuration, the antenna device has a high strength. Further, a corrugated horn antenna may be used as the primary radiator for such an antenna device in order to achieve a low side-lobe characteristic. The corrugated horn antenna includes bellows-like protrusions on its inner wall surface, and these bellows-like protrusions can lower the side-lobe.

CITATION LIST

Patent Literature

Patent Literature 1: Japanese Unexamined Patent Application Publication No. H07-046031

SUMMARY OF INVENTION

Technical Problem

It should be noted that the antenna device disclosed in Patent Literature 1 is composed of a number of components and requires a support component in order to precisely position the sub-reflector.

The present invention has been made to solve the above-described problem and an object thereof is to provide an antenna device capable of performing precise positioning by using a small number of components and having a low side-lobe characteristic.

Solution to Problem

An antenna device according to the present invention includes:

a primary radiator;

a main-reflector;

a sub-reflector; and a holding section that fixedly maintains relative positions and directions of the sub-reflector and the main-reflector, in which the holding section includes a side part in an integrated manner, the side part being configured to enclose at least a part of a radio-wave path extending from the primary radiator to the sub-reflector as a shroud.

This configuration enables the holding section to hold and precisely position the sub-reflector and the main-reflector by the one component while eliminating the need for a support component for supporting the sub-reflector. Further, the holding section prevents the leak of radio waves and lowers the side-lobe.

Advantageous Effects of Invention

According to the present invention, it is possible to provide an antenna device capable of performing precise positioning by using a small number of components and having a low side-lobe characteristic.

DESCRIPTION OF EMBODIMENTS

Figure 1:
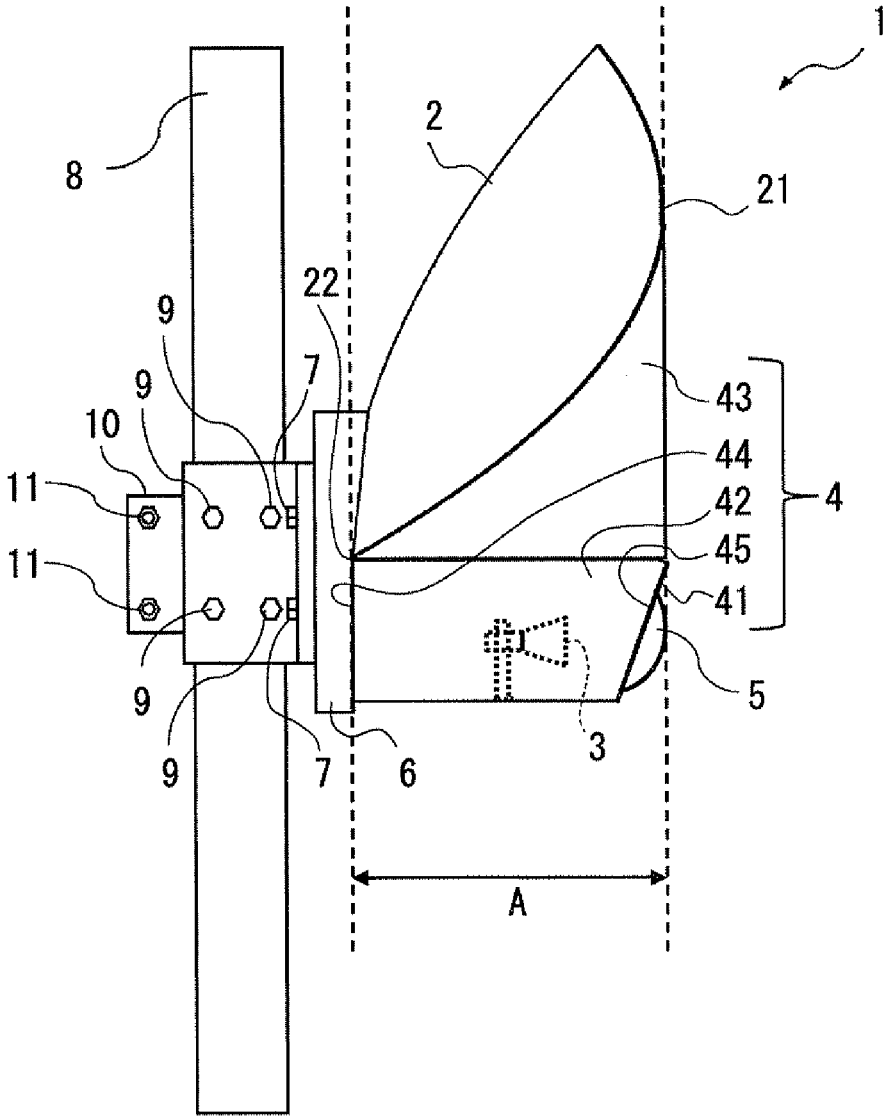
FIG. 1 is a side view of an antenna device according to an exemplary embodiment.
Figure 2:
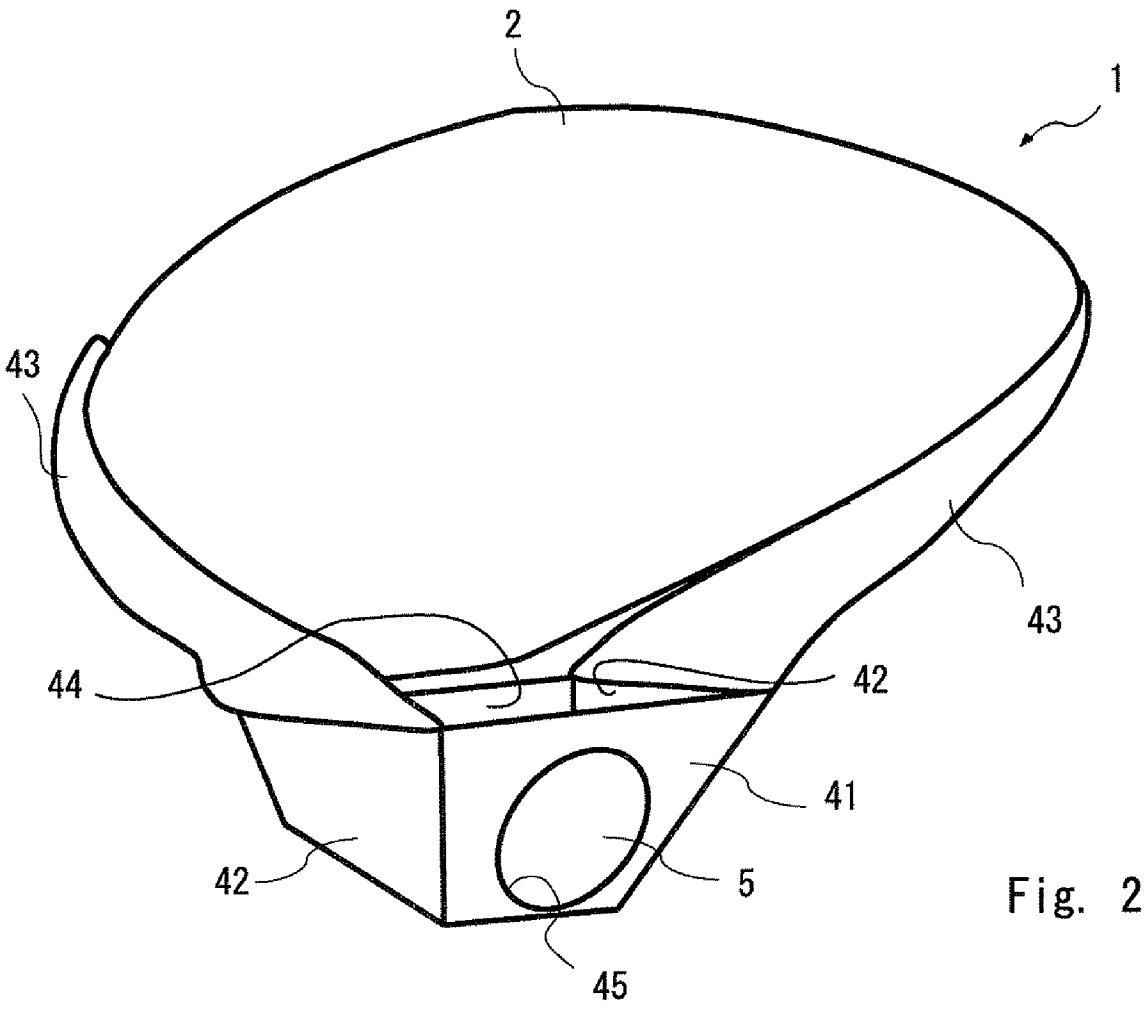
FIG. 2 is a perspective view of the antenna device according to the exemplary embodiment.
Figure 3:
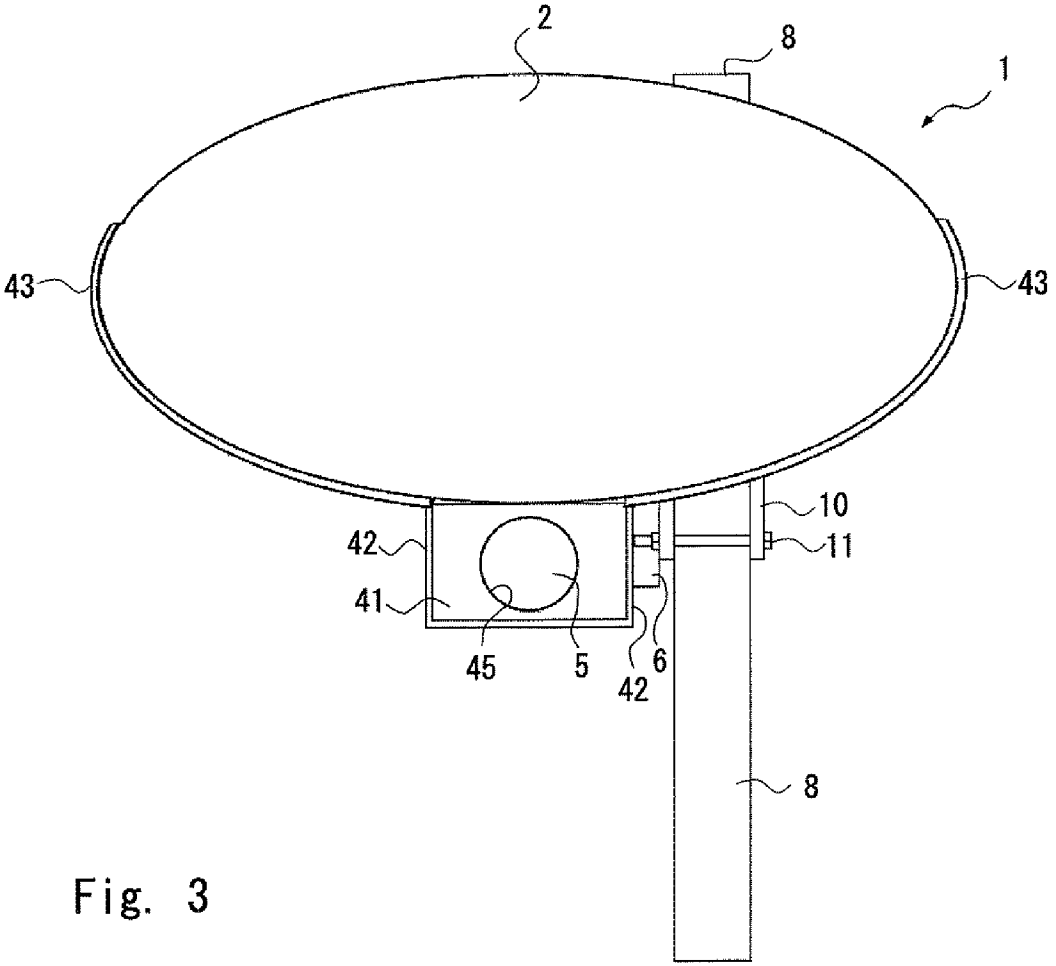
FIG. 3 is a front view of the antenna device according to the exemplary embodiment.

Exemplary embodiments according to the present invention are explained hereinafter with reference to FIGS. 1 to 3. FIG. 1 shows a side of an antenna device attached to a pole. FIG. 2 shows a perspective view of the antenna device. FIG. 3 shows the front of the antenna device attached to the pole. Note that in FIGS. 2 and 3, the illustration of a primary radiator 3, which is described later, is omitted.

As shown in FIG. 1, the antenna device 1 includes a main-reflector 2, a primary radiator 3, a holding section 4, and a sub-reflector 5.

The main-reflector 2 is, for example, a reflector having a paraboloid having a predetermined depth and a predetermined diameter as its reflecting surface. The aperture (i.e., opening surface) of the main-reflector 2 is elliptic.

Any kind of antenna may be used for the primary radiator 3, provided that it has a predetermined beam width. For example, a dielectric antenna, a patch antenna, a slot antenna, or the like can be used as the primary radiator 3. The primary radiator 3 is disposed inside the holding section 4 in such a manner that its radio-wave emitting direction is directed toward the sub-reflector 5.

As shown in FIG. 2, the holding section 4 is made of, for example, a material that absorbs electromagnetic waves such as a metal, and has a roughly hollow rectangular parallelepiped shape with an opened top end. The holding section 4 includes a front part 41, side parts 42, enclosure parts 43, and a rear part 44. The front part 41 has a holding hole 45 in which the sub-reflector 5 is inserted. The holding hole 45 fixedly maintains the position and the direction of the sub-reflector 5. The side parts 42 fix the respective enclosure parts 43 in an integrated manner by using fixing means such as welding and bolt-tightening. The side parts 42 are vertically disposed in a continuous and integrated manner with respect to the front part 41. The enclosure parts 43 rise (i.e., extend) from the top ends of the respective side parts 42 and connect to at least a part of the fringe part of the main-reflector 2. In this way, the enclosure parts 43 hold the main-reflector 2 so as to fix the position and the direction of the main-reflector 2, and function as a shroud. The enclosure parts 43 enclose at least a part of a radio-wave path extending from the sub-reflector 5 to the main-reflector 2. The holding section 4 fixedly maintains the relative positions and the directions of the sub-reflector 5 and the main-reflector 2. The rear part 44 is attached to an antenna mount. The front part 41, the side parts 42, the enclosure parts 43, and the rear part 44 of the holding section 4 cover at least a part of a radio-wave path extending from the primary radiator 3 to the sub-reflector 5. Note that the holding section 4 may have holes as long as the antenna device 1 can maintain a necessary side-lobe characteristic and a necessary mechanical strength. For example, a number of holes may be formed in the side parts 42. Further, the enclosure parts 43 and the side parts 42 may be integrally formed by molding them as one component. The front part 41 and the side parts 42 may be formed by bending one plate, or may be manufactured by welding a plurality of plates to each other.

Note that in this exemplary embodiment, the holding section 4 has a roughly hollow rectangular parallelepiped shape as described above. However, the holding section 4 may be any kind of structure that can cover at least a part of the radio-wave path extending from the primary radiator 3 to the sub-reflector 5 and the paraboloid of the sub-reflector 5. For example, the holding section 4 may have a cylindrical shape. Further, an electromagnetic-wave absorber may be disposed on the inner wall of the holding section 4.

Similarly to the main-reflector 2, the sub-reflector 5 is, for example, a reflector having a paraboloid having a predetermined depth and a predetermined diameter as its reflecting surface. As described above, the sub-reflector 5 is held by the holding section 4. Note that as shown in FIG. 1, letting "horizontal length A" represent a length from the front end 21 of the main-reflector 2 to the rear end 22 thereof, it is desirable that the sub-reflector 5 be housed within the range of the horizontal length A of the main-reflector from the rear end 22 of the main-reflector 2 so that the leak of radio waves can be reduced (or prevented).

Note that although the aperture (i.e., opening surface) of the main-reflector 2 is elliptic in this exemplary embodiment, it may be circular in other exemplary embodiments. Further, although the sub-reflector 5 is inserted into the holding hole 45 and thereby held by the holding section 4 in this exemplary embodiment, the sub-reflector 5 is preferably integrally formed with the holding section 4. In this way, the relative positional relation between the sub-reflector 5 and the main-reflector 2 can be fixedly maintained more reliably. Further, although the primary radiator 3 is disposed inside the holding section 4 with its radio-wave emitting direction being directed toward the sub-reflector 5, the primary radiator 3 may be disposed near the attaching place of the antenna device 1.

(How to Use)

Figure 4:
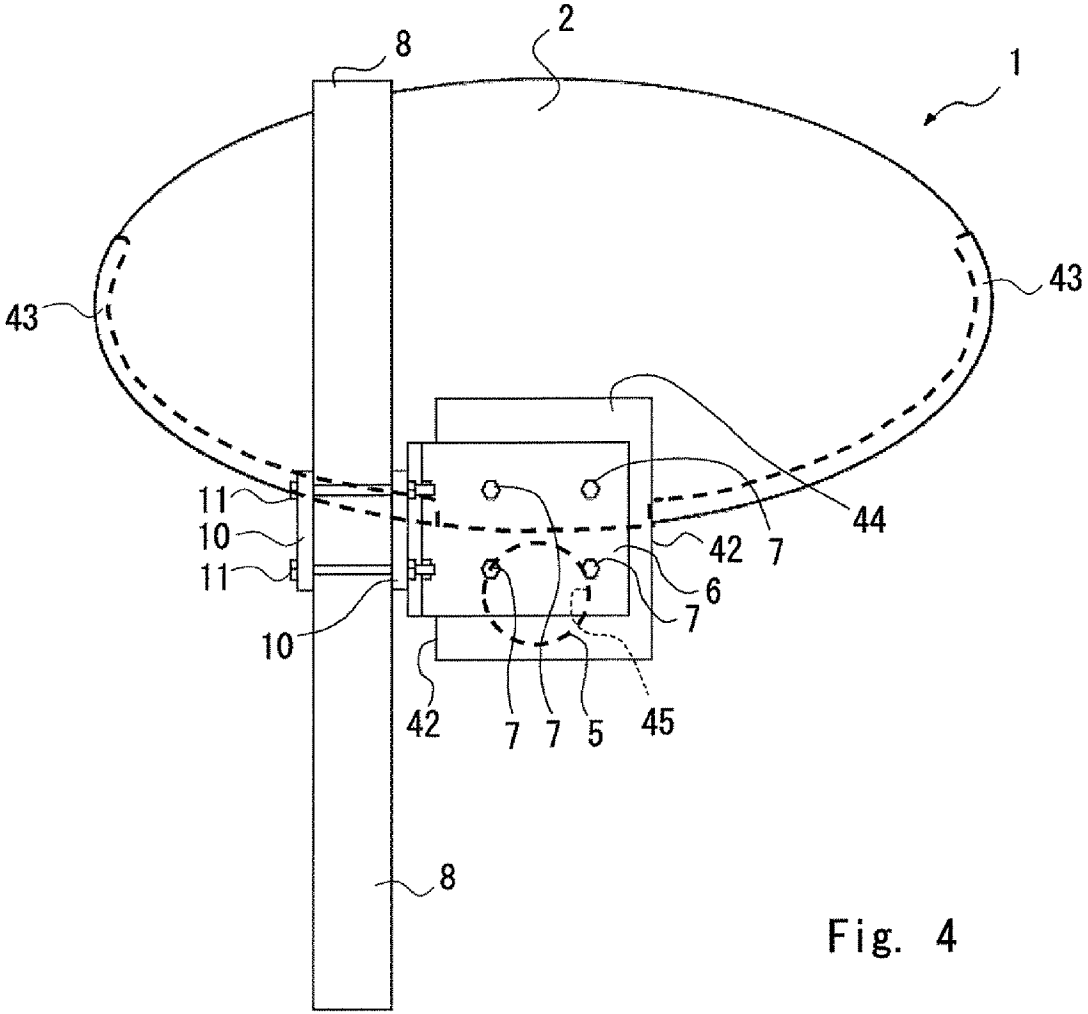
FIG. 4 is a rear view of the antenna device according to the exemplary embodiment.

How to use the antenna device 1 is explained hereinafter with reference to FIGS. 1, 3 and 4. FIG. 4 shows the rear surface of the antenna device attached to the pole. As shown in FIGS. 1, 3 and 4, the antenna device 1 is fixed to a pole 8 through an antenna mount 6 and pole fixing means 10. Specifically, the antenna mount 6, which is an L-shaped plate member, is attached to the rear part 44 of the holding section 4 by, for example, tightening bolts 7 in one end of the antenna mount 6. Further, the antenna mount 6 is attached to the pole fixing means 10 by, for example, tightening bolts 9 in the other end of the antenna mount 6 (see FIG. 1). The pole fixing means 10, to which the antenna device 1 and the antenna mount 6 are attached, is fixed to the pole 8 by, for example, tightening bolts 11. As a result, the antenna device 1 is fixed to the pole 8.

Note that when a radio wave is emitted from the primary radiator 3 (see FIG. 1) toward the sub-reflector 5, the sub-reflector 5 reflects the radio wave toward the main-reflector 2. Further, the main-reflector 2 reflects the radio wave. It should be noted that the holding section 4 fixedly maintains the relative positional relation between the main-reflector 2 and the sub-reflector 5 and thereby can perform precise positioning while eliminating the need for a support component and thereby reducing the number of necessary components. Further, since the holding section 4 is composed of an electromagnetic-wave absorber and has a structure for enclosing at least a part of the radio-wave path extending from the primary radiator 3 to the sub-reflector 5, the holding section 4 has a function of preventing the leak of radio waves from the sub-reflector 5 and serves as leak prevention means. Further, the enclosure parts 43 of the holding section 4 rise (i.e., extend) from the top ends of the side parts 42 and connect to at least a part of the fringe part of the main-reflector 2. In this way, since the enclosure parts 43 of the holding section 4 enclose at least a part of the radio-wave path extending from the sub-reflector 5 to the main-reflector 2, the enclosure parts 43 of the holding section 4 can prevent the leak of radio waves from the main-reflector 2. That is, the holding section 4 functions as leak prevention means of the antenna device 1. Further, by disposing the sub-reflector 5 within the range of the horizontal length A from the rear end 22 of the main-reflector 2 (see FIG. 1), the leak of radio waves from the sub-reflector 5 can be reduced even further. Further, this arrangement can reduce the size of the antenna device.

Further, the above-described configuration can maintain a necessary low side-lobe characteristic even when a horn antenna having a smooth inner wall surface is used, instead of using a corrugated horn antenna, as the primary radiator. That is, a horn antenna having a smooth inner wall surface as well as a corrugated horn antenna can be used as the primary radiator 3. A horn antenna having a smooth inner wall surface does not require a cutting process and hence its cost is lower than that for a corrugated horn antenna, though its low side-lobe characteristic is not as good as that of the corrugated horn antenna. That is, it is possible to perform precise positioning by using a smaller number of components and using a horn antenna having a smooth inner wall surface while maintaining a necessary low side-lobe characteristic. In addition, it is possible to manufacture an antenna deice at a lower cost.

Note that the invention is not limited to the above-described exemplary embodiments and various changes may be made therein without departing from the spirit and scope of the present invention.

Although the present invention is explained above with reference to exemplary embodiments, the present invention is not limited to the above-described exemplary embodiments. Various modifications that can be understood by those skilled in the art can be made to the configuration and details of the present invention within the scope of the invention.

This application is based upon and claims the benefit of priority from Japanese patent applications No. 2012-

288918, filed on Dec. 28, 2012, the disclosure of which is incorporated herein in its entirety by reference.

INDUSTRIAL APPLICABILITY

The present invention relates to an antenna device, and in particular an antenna device including a primary radiator, a main-reflector, and a sub-reflector.

REFERENCE SIGNS LIST

1 ANTENNA DEVICE
2 MAIN-REFLECTOR
3 PRIMARY RADIATOR
4 HOLDING SECTION
5 SUB-REFLECTOR
6 ANTENNA MOUNT
7, 9, 11 BOLT
8 POLE
10 POLE FIXING MEANS
41 FRONT PART
42 SIDE PART
43 ENCLOSURE PART
44 REAR PART
45 HOLDING HOLE

The invention claimed is:

1. An antenna device comprising:
a primary radiator;
a main-reflector including an elliptic aperture;
a sub-reflector; and
a holding section fixedly maintaining relative positions and orientations of the sub-reflector and the main-reflector, the holding section including an integrated side part enclosing at least a portion of a radio-wave path extending from the primary radiator to the sub-reflector as a shroud.

2. The antenna device according to claim 1, wherein the sub-reflector and the holding section are integrally formed.

3. The antenna device according to claim 1, wherein:
the holding section further includes an enclosure part covering at least a portion of a radio-wave path extending from the sub-reflector to the main-reflector as a shroud;
the enclosure part extends from a top end of the side part and connects to at least a portion of a fringe part of the main-reflector; and
the enclosure part fixedly maintains a relative position and orientation of the main-reflector.

4. The antenna device according to claim 1, wherein:
the main-reflector includes a front end and a rear end; and
the sub-reflector is disposed between the front end and the rear end of the main-reflector as measured in a horizontal direction.

5. The antenna device according to claim 1, wherein the primary radiator is disposed inside the holding section.

6. The antenna device according to claim 1, wherein the primary radiator is a horn antenna having a smooth inner wall surface.

7. An antenna device comprising:
a primary radiator;
a main-reflector;
a sub-reflector; and
a holding section fixedly maintaining relative positions and orientations of the sub-reflector and the main-reflector, the holding section including:
an enclosure part covering at least a portion of a radio-wave path extending from the sub-reflector to the main-reflector as a shroud, the enclosure part extending from a top end of the side part and connecting to at least a portion of a fringe part of the main-reflector, the enclosure part fixedly maintaining a relative position and orientation of the main-reflector; and
an integrated side part enclosing at least a portion of a radio-wave path extending from the primary radiator to the sub-reflector as a shroud.

8. The antenna device according to claim 7, wherein the sub-reflector and the holding section are integrally formed.

9. The antenna device according to claim 7, wherein:
the main-reflector includes a front end and a rear end; and
the sub-reflector is disposed between the front end and the rear end of the main-reflector as measured in a horizontal direction.

10. The antenna device according to claim 7, wherein the primary radiator is disposed inside the holding section.

11. The antenna device according to claim 7, wherein the primary radiator is a horn antenna having a smooth inner wall surface.

12. The antenna device according to claim 7, wherein an aperture of the main-reflector is elliptic.

13. The antenna device according to claim 7, wherein an aperture of the main-reflector is circular.

14. An antenna device comprising:
a primary radiator including a horn antenna having a smooth inner wall surface;
a main-reflector;
a sub-reflector;
a holding section fixedly maintaining relative positions and orientations of the sub-reflector and the main-reflector, the holding section including an integrated side part enclosing at least a portion of a radio-wave path extending from the primary radiator to the sub-reflector as a shroud.

15. The antenna device according to claim 14, wherein the sub-reflector and the holding section are integrally formed.

16. The antenna device according to claim 14, wherein:
the main-reflector includes a front end and a rear end; and
the sub-reflector is disposed between the front end and the rear end of the main-reflector as measured in a horizontal direction.

17. The antenna device according to claim 14, wherein:
the holding section further includes an enclosure part covering at least a portion of a radio-wave path extending from the sub-reflector to the main-reflector as a shroud;
the enclosure part extends from a top end of the side part and connects to at least a portion of a fringe part of the main-reflector; and
the enclosure part fixedly maintains a relative position and orientation of the main-reflector.

18. The antenna device according to claim 14, wherein the primary radiator is disposed inside the holding section.

* * * * *